United States Patent [19]

Gossett et al.

[11] 3,936,123

[45] Feb. 3, 1976

[54] ELECTRICAL PLUG EJECTING APPARATUS

[76] Inventors: Willie P. Gossett, 13621 Far Hills, Dallas, Tex. 75240; Robert F. White, Box 479, Mount Vernon, Tex. 75457

[22] Filed: Oct. 23, 1974

[21] Appl. No.: 517,219

[52] U.S. Cl. ..... 339/45 M; 339/45 R

[51] Int. Cl.[2] ..... H01R 13/62

[58] Field of Search ..... 339/45, 46, 103

[56] References Cited

UNITED STATES PATENTS

| | | | |
|---|---|---|---|
| 2,955,273 | 10/1960 | Winkler | 339/45 M |
| 3,111,355 | 11/1963 | Samburoff et al. | 339/45 M X |
| 3,387,254 | 6/1968 | Wheeler | 339/103 R |
| 3,737,835 | 6/1973 | Clement et al. | 339/45 R |

*Primary Examiner*—Joseph H. McGlynn
*Assistant Examiner*—Craig R. Feinberg
*Attorney, Agent, or Firm*—Kenneth R. Glaser

[57] ABSTRACT

Disclosed is electrical plug ejecting apparatus having an elongated housing adapted to transversely retain the electrical plug, the housing defining a pair of spaced compartments disposed on opposite sides of the retained plug with ejector springs latchably retained within the compartments by trap doors tripably released by pivotal movement of a trip lever in response to the lateral movement of the line cord coupled to the electrical plug.

5 Claims, 4 Drawing Figures

ELECTRICAL PLUG EJECTING APPARATUS

This invention pertains to electric plug ejecting apparatus; more particularly to electric plug ejecting apparatus responsive to the twisting or bending of the line cord connected with the plug; and even more particularly to electric plug ejecting apparatus employing latchably engaged springs which, when tripably released, eject the electric plug from the wall socket.

There are many instances where an electrical plug, while retained within the wall socket, is subjected to considerable abuse and damage. For example, in hospitals and similar institutions, the electrically operated bed must often be moved back and forth by the attendants; and during such movement, the line cord and plug are often twisted, banged into, and generally subjected to constant abuse, which eventually results in the plug breaking off in the socket. As a consequence, thousands of dollars are spent annually by hospitals and other institutions in replacing these broken plugs.

Furthermore, either because of the inconvenient location of the wall socket or the excessively firm connection between the electric plug and the outlet resisting ready removal of the plug from a socket, it is often desirable to remove the electric plug from the socket by pulling or otherwise manipulating the line cord itself. Such expedient, however, usually results in the separation of the cord from the plug, again requiring the replacement of the plug.

To overcome these various disadvantages, attempts have been made to provide apparatus for automatically and conveniently ejecting the electric plug from the wall socket. Prior to the present invention, however, all of the existing electric plug ejecting mechanisms have not been entirely satisfactory in overcoming the above stated problems. Furthermore, no apparatus presently exists which would suitably and responsively eject the plug from its socket when the plug and line cord are subjected to the twisting and bending encountered in hospitals or the like.

It is therefore a principal object of the present invention to provide a new and improved electric plug ejecting apparatus.

It is a further object of the present invention to provide new and improved apparatus for ejecting electrical plugs from wall sockets in response to the bending or twisting of the line cord coupled to the plug.

It is an even further object of the present invention to provide new and improved plug ejecting apparatus of the type incorporating latchably engaged ejector springs which, when tripably released, are effective to quickly and efficiently remove the plug from its socket.

In accordance with these and other objects, the present invention is directed to an electric plug ejecting mechanism comprising an elongated housing adapted to retain the electric plug therein and containing a pair of latchably engaged ejector springs. A trip release mechanism responsive to the lateral movement or bending of the line cord coupled with the plug uniquely releases the ejector springs in order to effect the plug ejecting operation.

Specific features, advantages, as well as other objects of the invention will become more readily understood from the following detailed description taken in conjunction with the attached drawings, wherein identical numerals refer to similar parts, and wherein.

Figures 3, 4:
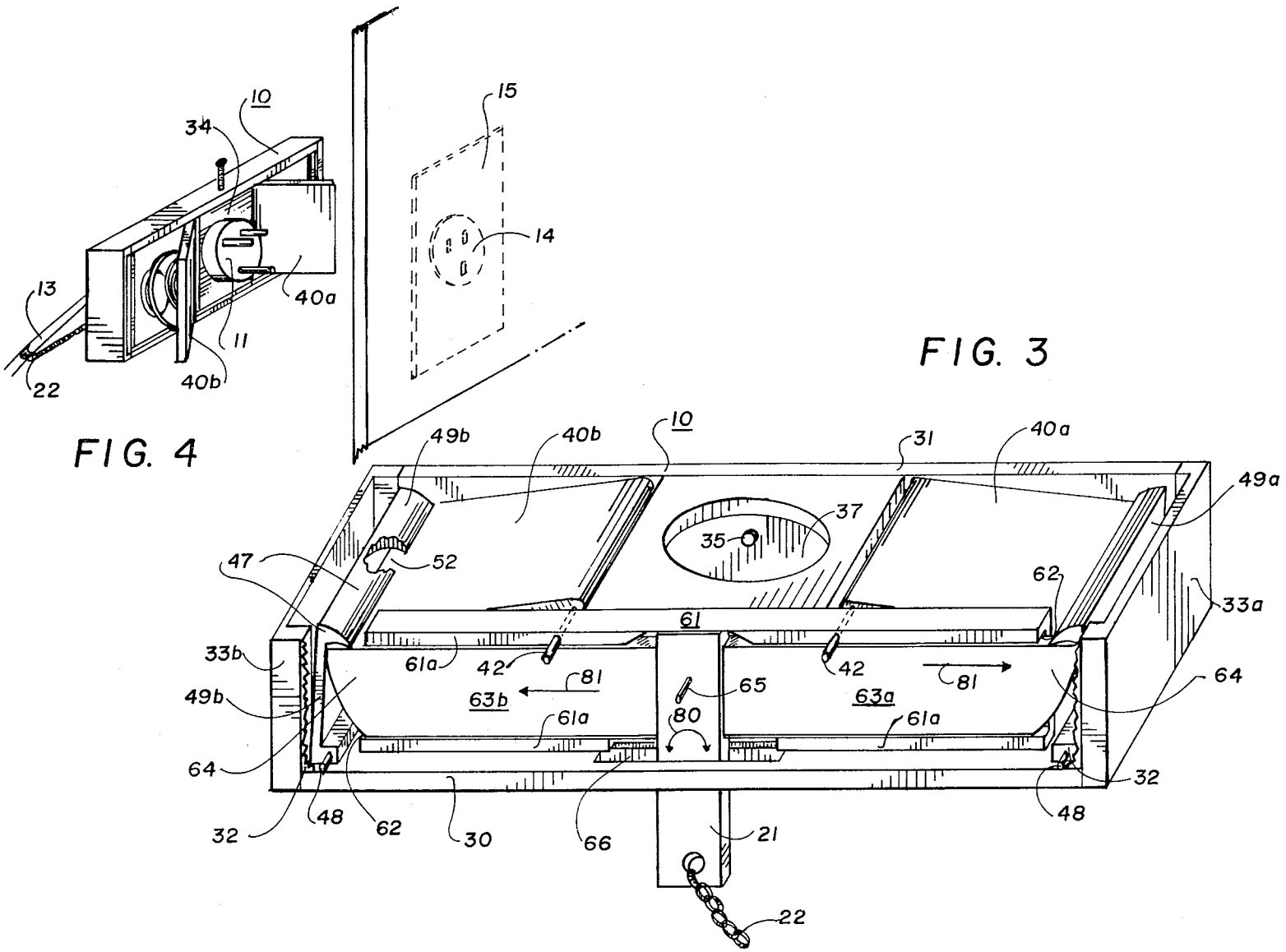

FIG. 3 is a perspective view of the ejecting mechanism of the present invention with the ejector springs retained in their latched condition and with a portion of the bottom wall illustrated as being removed in order to more clearly depict the trip release mechanism; and FIG. 4 is a pictorial illustration of an electric plug in combination with, and retained by, the housing of the electric plug ejecting mechanism of the present invention, viewed from the front of the housing.

Figures 1, 2:
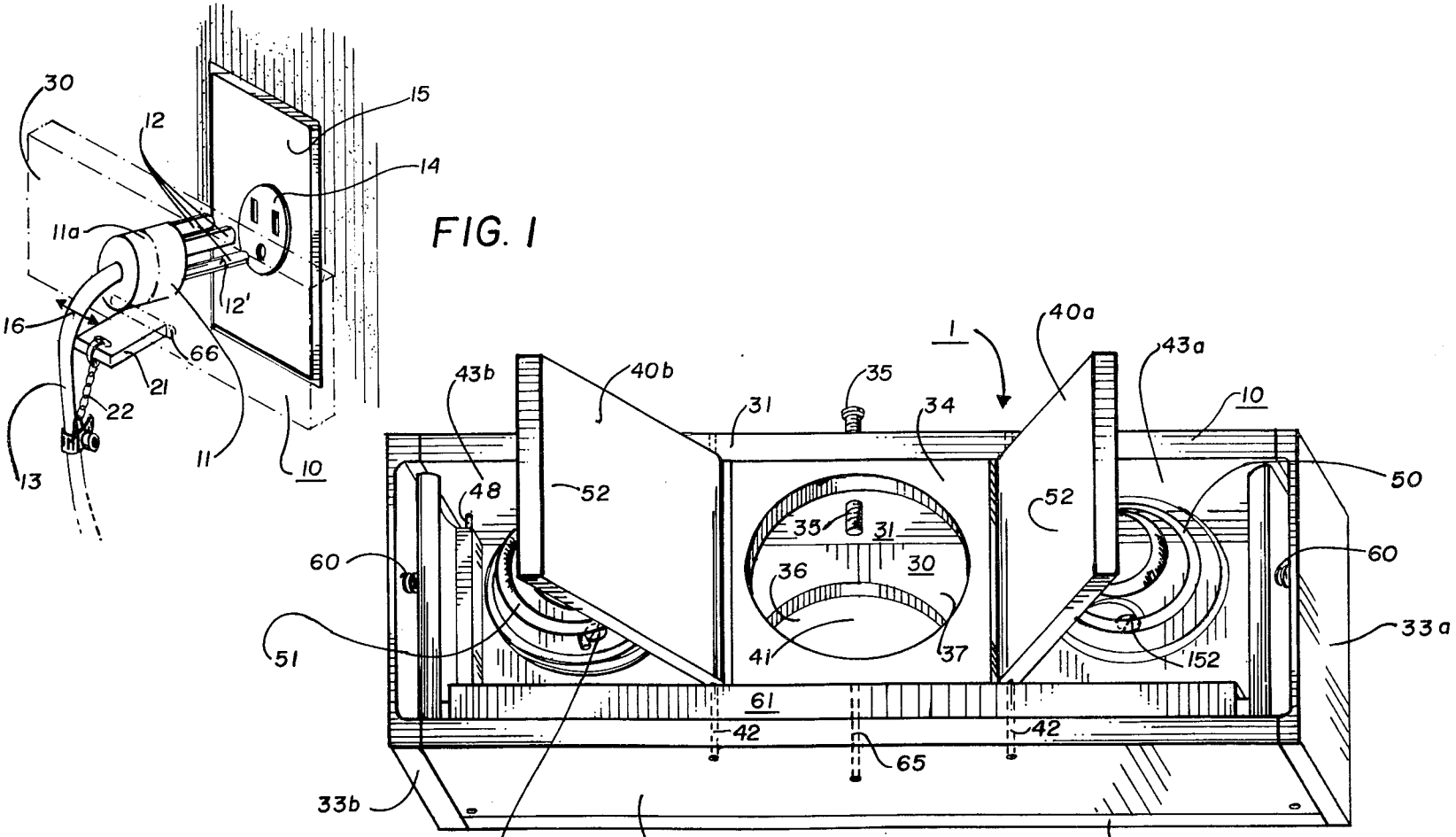
FIG. 1 is a pictorial illustration of an electric plug in combination with, and retained by, the housing of the electric plug ejecting mechanism of the present invention, viewed from the rear of the housing.
FIG. 2 is a perspective view showing the front and bottom view of the plug ejecting mechanism of the present invention illustrating the ejector springs in their released condition.

Referring initially to FIG. 1, a conventional electric plug 11 is pictured in conjunction with, and being retained by, a housing 10 (depicted in phantom), the housing 10 forming an integral part of the overall plug ejecting mechanism which is subsequently described in greater detail. The electric plug 11, as is well known, has standard conductor prongs 12 (including a ground prong 12'), a coupled line cord 13, and is adapted to be mateably received in the customary manner within a conventional wall outlet 14 surrounded by a cover plate 15. While the electrical plug 11 is depicted for convenience in the drawing as having a third or "ground" prong, the plug could also be of the conventional two-prong configuration, the actual design and characteristics of the electrical plug, coupled line cord, and electrical outlet receptacle not being critical to the present invention.

As subsequently described in more detail, when the plug (or conductor prongs) is inserted within the outlet 14, the front or forward portion of the housing 10 will be immediately adjacent, if not flush with, the plate 15 and surrounding wall. A trip release mechanism for effecting the ejection of the plug from the outlet, the details and operation of which are subsequently described, includes a pivotally mounted trip lever 21 extending from the rear of the housing 10 and chain-pull 22, the latter being connected to the line cord 13 at a location remotely spaced from the main body portion 11a of the plug 11. Lateral movement of the cord 13 (in direction of arrow 16) will actuate the trip release mechanism to initiate the ejection operation.

Referring now to FIGS. 2 and 3, the plug ejecting mechanism 1 of the present invention principally comprises the ejector housing 10 which is defined by a longitudinally extending rear wall 30, respective top and bottom walls 31 and 32 (the major portion of which is broken away in FIG. 3 for convenience of viewing), and end walls **33*a* and 33*b*. Additionally, the front or forward portion of the housing 10 is defined by a pair of doors 40*a* and 40*b* pivotally mounted immediately adjacent, and on opposite sides of, a central wall portion 34. A cavity 41** is thus defined by the enclosing walls of the housing and extends for the entire longitudinal dimension of the housing. The entire housing can be fabricated in any conventional manner; for example, it can be readily molded from a synthetic resinous or plastic material employing standard molding dies.

Respectively disposed within the rear wall 30 and the central wall portion 34 are a pair of mutually aligned openings 36 and 37, which openings are adapted to receive the main body portion 11a of the electric plug 11 which passes therethrough (and thus through the housing cavity 41), the plug adapted to be secured within these openings (and thus with the housing) by a conventional set screw 35 threadably received within the top wall 31. As a consequence, the housing 10 is adapted to retain various sizes and shapes of electrical plugs therewith with the conductive prongs 12 extending from, and transverse to, the forward wall (specifically wall portion 34) of the housing (as best illustrated in FIG. 4).

Each of the doors 40*a* and 40*b* are pivotally mounted to the housing by way of pins 42 and are thus adapted for opening or closing the entrance to respective portions of the cavity 41 designated as compartments 43*a* and 43*b*. Respectively located within each of these compartments are ejector springs 50 and 51 having one end secured to the rear wall 30 by screws 152, for example, these springs being compressed and urged against the inside of the doors 40*a* and 40*b* when these doors are in their closed position (position shown in FIG. 3).

Pivotally mounted at their base adjacent the end walls 33*a* and 33*b* (by way of pins 48 extending through top and bottom walls 31 and 32) are respective latch plates 49*a* and 49*b*. Each of these latch plates is provided with a latching edge or finger 47 (illustrated most clearly in FIG. 3) adapted to latchably engage the end portion 52 of the doors 40*a* and 40*b*. The latch plates are normally urged or biased in this latching position by springs 60 (FIG. 2) which are respectively secured at one end to the inner surface of the end walls 33*a* and 33*b*, the free ends of these springs engaging the latch plates above their pivot points and urging same inward in order to latch the compartment doors 40*a* and 40*b* in their closed position shown in FIG. 3.

Adjacent the bottom wall 32 of the housing 10 and extending substantially the entire length thereof is a guide block 61 having flange portions 61*a* which, along with the wall 32, define an elongated channel 62 coextensive therewith. Disposed within the channel 62, and adapted to be translated therein, are a pair of latch trip release arms 63*a* and 63*b* forming part of a trip release mechanism, the trip release arms having end portions 64 adapted to engage the inside surface of the latch plates 49*a* and 49*b*. The trip lever 21, which extends through the slot 66 in the rear of the housing, is pivotally mounted within the channel 62 (by way of pin 65 passing through the lever, guide block 61, and wall 32) intermediate the latch trip release arms 63*a* and 63*b*. Thus, when the lever 21 is pivoted in either the clockwise or counter-clockwise direction (direction of arrows 80 in FIG. 3), both release arms 63*a* and 63*b* are translated in the direction of arrows 81, pivoting the latch plates 49*a* and 49*b* out of latching engagement with doors 40*a* and 40*b*, and releasing the springs 50 and 51 from compression. The spring biased latch plates then return the arms (63*a*, 63*b*) and the trip lever 21 to their original rest position (FIG. 3).

The operation of the electric plug ejecting mechanism of the present invention is now described. Accordingly, the electric plug 11 is initially inserted through the openings 36 and 37 of the housing so as to position the conductor prongs 12 forward, and extending from, the front surface of the housing 10 (as illustrated in FIG. 4), the set screw 35 maintaining the plug in this substantially transverse position. The pullchain 22 is then secured to the line cord 13, as illustrated in FIG. 1. The doors 40*a* and 40*b* are pivoted closed to compress the springs 50 and 51 and are maintained in this closed position by the latch plates 49*a* and 49*b*, as clearly shown in FIG. 3. The plug is then inserted within the wall socket in the conventional manner, the front face of the housing 10 being disposed immediately adjacent, and normally flush, with the wall socket and adjacent wall.

If, at any time, an object such as a hospital bed or the like is pushed up against the plug and cord, the line cord 13 would normally be bent or twisted in either of the lateral directions depicted by the arrows 16 in FIG. 1, thus pivoting the trip lever 21 in the clockwise or counter-clockwise direction (arrow 80). This then results in the reciprocative translation of the arms 63*a* and 63*b*, pivoting the latch plates 49*a* and 49*b* out of latching engagement with the doors 40*a* and 40*b*, allowing these doors to spring open under the influence of the compressed ejector springs 50 and 51. As a consequence, the resulting force transmitted by these springs is effective to immediately force the housing away from the wall and wall socket, removing the electric plug from the wall socket.

As may be apparent, it is also possible to eject the plug from the wall socket by the purposeful lateral movement of the line cord 13; or alternatively, by manually pivoting the trip lever 21.

Various modifications of the disclosed embodiment, as well as additional embodiments, of the present invention may become apparent to those skilled in the art after reviewing the foregoing description without departing from the spirit and scope of the invention as solely defined by the following claims:

What is claimed is:

1. An electrical plug ejecting mechanism, comprising:

a. an ejector housing defined by front and rear longitudinally extending wall portions, a centrally defined opening in said housing extending transverse to said longitudinal direction and through said front and rear wall portions, b. means for retaining an electrical plug within said opening in a manner that allows the conductive prongs of said plug to forwardly extend from said front wall portion, c. a pair of compartments within said housing longitudinally spaced from one another on opposite sides of said centrally defined opening, d. a pair of ejector springs respectively disposed within said compartments, e. a pair of doors forming a part of said front wall portion so mounted to said housing to respectively close off said compartments and maintain said ejector springs under compression when in such closed position, f. latch means latching said doors in said closed position, and g. trip release means including a trip lever for releasing said latch means from said latching position, thereby to allow said doors to open and release said ejector springs from compression, said trip release means being actuated in response to a force exerted on said trip lever in said longitudinal direction.

2. The mechanism as defined by claim 1 further including a guide block defining a longitudinally extending channel; said trip release means further comprising a pair of trip release arms translatably receivable within said longitudinally extending channel, said trip lever being disposed intermediate said trip release arms and pivotally mounted to translate said trip release arms against, and for releasing, said latch means.

3. The apparatus as defined by claim 2 wherein said latch means comprises a pair of latch plates pivotally mounted at their base and respectively having latching edges adapted to latchably engage end portions of said doors.

4. The apparatus as defined by claim 3 further including springs biasing said latch means into latchable engagement with said doors.

5. Electrical plug ejecting apparatus, comprising:

a. an ejector housing defined by front, rear, and side wall portions defining therebetween a longitudinally extending cavity, pivotally mounted doors providing a portion of said front wall portion adapted for opening or closing off the entrance to longitudinally spaced compartments of said cavity, b. means for retaining an electrical plug within, and transverse to, said housing intermediate said spaced compartments, c. a pair of ejector springs respectively disposed within said compartments and attached to said rear wall portion, d. latch plates respectively pivotally mounted adjacent said end walls and having latching surface edges adapted to latchably engage said doors, e. a pair of springs secured to said end walls and adapted to bias said latch plates into latching engagement with said doors, and f. trip release means for releasing said latch plates from latchable engagement with said doors, said trip release means comprising guide block means defining an elongated channel substantially coextensive with said longitudinally extending cavity, a pair of latch trip release arms translatably mounted within said elongated channel and having end portions adapted to engage the inside surface of said latch plates, a trip lever pivotally mounted intermediate said latch trip release arms and extending through an opening in said rear wall, the clockwise or counter-clockwise movement of said trip lever translating said trip release arms to force said latch plates out of latchable engagement with said doors, the remote end portion of said trip lever being connected with the electric cord associated with said electrical plug, whereby the lateral movement of said cord pivots said trip lever to release said ejector springs, thereby to eject said electrical plug from engagement with a wall socket.

* * * * *